United States Patent [19]

Nemoto et al.

[11] Patent Number: 4,508,601

[45] Date of Patent: Apr. 2, 1985

[54] PROCESS FOR PRODUCING A THIN TIN AND ZINC PLATED STEEL SHEET

[75] Inventors: Tadashi Nemoto, Kudamatsu; Ryoichi Fukumoto, Yamaguchi; Hiroaki Kawamura; Yoshikazu Kondo, both of Kudamatsu; Tsuneo Inui, Tokuyama, all of Japan

[73] Assignee: Toyo Kohan Co., Ltd., Tokyo, Japan

[21] Appl. No.: 415,885

[22] Filed: Sep. 7, 1982

[51] Int. Cl.[3] ..... C25D 5/48; C25D 5/50

[52] U.S. Cl. ..... 204/38.5; 204/37.3; 204/27; 204/54 R; 204/55 R; 427/436; 427/383.7; 427/437

[58] Field of Search ..... 204/40, 55 R, 38 S, 204/37 T, 54 R, 27; 427/436, 383.7, 437

[56] References Cited

U.S. PATENT DOCUMENTS

| | | | |
|---|---|---|---|
| 2,976,169 | 3/1961 | Streicher | 427/436 |
| 3,930,831 | 12/1975 | Shinomiya | 427/436 |
| 3,997,301 | 12/1976 | Yoshihara | 204/37 T |
| 4,027,055 | 5/1977 | Schneble, Jr. | 427/436 |
| 4,113,580 | 12/1978 | Tsutsui et al. | 204/37 T |
| 4,145,263 | 3/1979 | Tsutsui et al. | 204/35 R |
| 4,194,913 | 3/1980 | Davis | 427/437 |
| 4,229,268 | 10/1980 | Lowery et al. | 204/55 R |
| 4,234,631 | 11/1980 | Davis | 427/437 |
| 4,269,625 | 5/1981 | Molenaar | 427/437 |
| 4,310,392 | 1/1982 | Kohl | 204/55 R |

FOREIGN PATENT DOCUMENTS

| | | | |
|---|---|---|---|
| 48-18929 | 9/1973 | Japan | 204/37 T |
| 49-54233 | 5/1974 | Japan . | |
| 49-37829 | 8/1974 | Japan | 204/37 T |
| 49-88730 | 8/1974 | Japan . | |
| 50-091119 | 11/1975 | Japan | 204/37 T |
| 53-65230 | 6/1978 | Japan . | |
| 57-101694 | 6/1982 | Japan | 204/385 |

*Primary Examiner*—Howard S. Williams
*Assistant Examiner*—Terryence Chapman
*Attorney, Agent, or Firm*—Wenderoth, Lind & Ponack

[57] ABSTRACT

A process for producing a thin tin and zinc plated steel sheet which comprises electroplating zinc on a steel sheet from a zinc electroplating bath containing zinc ions followed by tin-plating the zinc plated steel sheet by immersion or by immersion followed by electroplating in a tinplating bath containing stannous ions, whereby zinc ions from the zinc plated steel sheet replace the stannous ions in the tinplating solution during the immersion tinplating. The resultant solution from the tinplating which contains zinc ions is recycled to make up the zinc electroplating bath.

21 Claims, No Drawings

PROCESS FOR PRODUCING A THIN TIN AND ZINC PLATED STEEL SHEET

FIELD OF THE INVENTION

The present invention relates to a process for producing a thin tin and zinc plated steel sheet by thin tin-plating by an immersion or by an electroplating after an immersion into an acidic tinplating bath after electroplating of zinc on a steel sheet by using a zinc plating bath produced by the substitution of stannous ion for zinc ion in said tinplating bath which is used for said tinplating.

DESCRIPTION OF THE INVENTION

Electrotinplated materials have been previously used for manufacturing cans such as food cans, five gallon cans and paint cans. Recently the changeover from expensive electrotinplated materials to cheaper tin free steel (TFS) consisting of metallic chromium and hydrated chromium oxide as well as a decrease in the weight of the tin coating in electrotinplated materials has rapidly occured in the can manufacturing field because the tin used for the production of tin-plated materials is very expensive and there is concern about possible exhaustion of tin resources throughout the world.

An ordinary metal can consists of two pieces of can ends and one piece of can body. As a method of seaming a TFS can body, electric welding is well known. Further, a method employing a nylon adhesive is widely used for beverage can bodies. In this electric welding of the TFS can body, however, the mechanical or chemical removal of TFS film consisting of metallic chromium layer and hydrated chromium oxide layer is indispensable for satisfaction welding. Therefore, the welded parts must be sufficiently coated by lacquer in order to prevent the corrosion.

On the other hand, the seaming of the tinplate can body is generally carried out by soldering. In the field of food cans, the use of expensive pure tin solder for the seaming of the tinplate can body increases because the lead content in the canned food is regulated by the FDA. Thus, it is difficult to decrease the tin coating weight in tinplates to below 1.0 g/m$^2$, because stable operation of the soldering at high speed becomes difficult.

Furthermore, as a method of seaming the tinplate can body, the employment of an organic adhesive such as nylon adhesive has been also proposed, for instance, in Japanese Laid-Open Patent Application No. Sho 49-37829 and Japanese Patent Publication No. Sho 48-18929.

However, the tinplate can body seamed by an organic adhesive may be broken when a beverage such as fruit juice is hot packed, because the bonding strength in the seam becomes remarkably low. Presently, such method is not considered practical.

Recently, a lap seam welding method, for instance the Sourdronic Process, has become widely used for the seaming of a tinplate can body such as an aerosol can and a dry fill can, instead of soldering.

As described above, both tinplate and TFS present certain problems as materials for welded cans. Namely, tinplate is expensive although it is easily welded at high speed and TFS is not satisfactorily welded without scraping off the TFS film.

In view of the background as described above, light tin coated steel sheets shown in U.S. Pat. No. 4,113,580 and U.S. Pat. No. 4,145,263 were developed several years ago.

However, these light tin coated steel sheets also present cartain problems. Namely, these sheets can not be welded without splashing under welding at high speeds such as 40 m/min.. Furthermore, the filiform corrosion in these sheets coated by lacquer may appear after aging in an atmosphere having high humidity.

SUMMARY OF THE INVENTION

It is an object of the present invention to provide a process for producing a thin tin and zinc plated steel sheet having an excellent weldability and an excellent filiform corrosion resistance.

This object can be accomplished by electroplating zinc on a steel sheet from a zinc electroplating bath containing zinc ions followed by tin-plating the zinc plated steel sheet by immersion or by immersion followed by electroplating in a tinplating bath containing stannous ions, whereby zinc ions from the zinc plated steel sheet substantially replace the stannous ions in the tinplating solution during the immersion tinplating. The resultant solution from the tinplating which contains zinc ions is employed to make up the zinc electroplating. The resultant coating on steel sheet, after the tinplating, contains 0.005–0.2 g/m$^2$ zinc and 0.05 to 1.0 g/m$^2$ tin.

In the present invention, the steel sheet decreased and pickled by ordinary methods is firstly electroplated by a suitable amount of zinc with due consideration of the dissolved amount of zinc and the amount of tin to be plated during immersion tinplating.

After that, the zinc plated steel sheet is further plated by tin by the immersion into the tinplating bath.

The deposition of tin from the tinplating bath occurs with the dissolution of the plated zinc into said tinplating bath.

Namely, both the reaction for the deposition of tin and the dissolution of the plated zinc occur simultaneously by the chemical substitution reaction between zinc and stannous ion.

Therefore, the tinplating bath gradually is converted to a zinc plating bath due to the substitution of stannous ions by zinc ions in said tinplating bath. In spite of the increase of zinc ion in said tinplating bath, tin is deposited on said zinc plated steel sheet due to the presence of stannous ion in said tinplating bath, because the standard electrode potential of zinc is less than that of tin. Namely, the tinplating bath can be used for tinplating until stannous ion in the tinplating bath is almost exhausted and after that this bath can be used again for the electroplating of zinc on the steel sheet in the present invention.

Furthermore, the exhausted solution consisting of a dilute tinplating bath in the conventional tinplating process is also used for producing a thin tin and zinc plated steel sheet according to the present invention with the recovery of stannous ion from the exhausted solution.

Therefore, the process according to the present invention is very economical method for producing a thin tin and zinc plated steel sheet.

DETAILED DESCRIPTION OF THE INVENTION

A thin tin and zinc plated steel sheet having an excellent weldability and an excellent filiform corrosion resistance which is the object of the present invention is obtained by an immersion plating or by an electroplating after an immersion plating of 0.05–1.0 g/m$^2$ of tin after electroplating 0.005–0.2 g/m$^2$ of zinc, by measurement after said tin-plating on a zinc plated steel sheet, according to the present invention.

In this tin and zinc plated steel sheet, the presence of zinc in the range of 0.005–0.2 g/m$^2$ by measurement after said tinplating is indispensable in order to improve weldability and prevent filiform corrosion.

If the amount of zinc is below 0.005 g/m$^2$, the weldability at high speed is not improved and the filiform corrosion is not prevented. At above 0.2 g/m$^2$ of zinc, the weldability at high speed is not also improved and the white rust due to the corrosion of zinc appears although the filiform corrosion is prevented.

If the amount of the plated tin is below 0.05 g/m$^2$, welding at high speed becomes very difficult and white rust due to the corrosion of zinc is not prevented. An increase in the amount to above 1.0 g/m$^2$ of tin is not economical, although the weldability does not deteriorate.

For an industrial operation, the present invention is carried out according to the following process: degreasing with an alkali solution and pickling with an acid solution→water rinsing→electroplating of zinc→water rinsing→tin-plating by immersion or by electroplating after immersion into tinplating bath→water rinsing→posttreatment for example by sodium dichromate used for conventional electroplating→water rinsing→drying→oiling, for example with dioctyl sebacate or cotton seed oil.

In this process, the bath containing the same anion and the same additives as those in the tinplating bath, besides zinc ion is, in principle, used for zinc plating. For the tinplating in the present invention, the known acidic tinplating bath for conventional electrotinplating is used, namely, an acidic bath such as a stannous sulfate bath, a stannous phenolsulfonate bath and a stannous halogenide bath and solutions prepared by reconstituting such exhausted solutions.

However, it is necessary in the present invention that a pH of the tinplating bath be below 1.7 in the stannous sulfate bath and the stannous phenolsulfonate bath and be below 4.0 in the stannous halogenide bath, and then the concentration of stannous ion in these tinplating baths is above 2 g/l.

If the pH of the tinplating bath is above 1.7 or 4.0, tin-plating by the immersion method is impossible because stannous ion is precipitated. If the concentration of stannous ion in these tinplating baths is below 2 g/l, a continuous operation for producing the thin tin and zinc plated steel sheet according to the present invention is difficult because stannous ion is consumed in a short time by the deposition of tin and is not supplied from anywhere. Although an increase in the amount of stannous ion in these tinplating baths does not adversely affect the immersion tinplating, it is desirable to limit the amount of stannous ion below 70 g/l from an economical viewpoint.

An increase in the amount of zinc ion in the tinplating bath is not limited in the present invention, because it does not affect the immersion tinplating, although the amount of zinc ion in the tinplating bath increases with a decrease of stannous ion. It is preferable to control the temperature of the tinplating bath in the range of 20°–60° C. from the industrial and economical viewpoints.

At a temperature of tinplating bath above 60° C., some additives such as ethoxylated α-naphthol sulfonic acid used in conventional electrotinplating bath may be decomposed.

Furthermore, the immersion time of the zinc plated steel sheet into the tinplating bath is preferably 0.1–5 seconds.

If the immersion time is below 0.1 seconds, the amount of tin required in the present invention is not deposited by the substitution reaction between stannous ion and the plated zinc.

In the immersion tinplating, the immersion time above 5 seconds is meaningless for producing at high speed a thin tin and zinc plated steel sheet according to the present invention, because the surface of the plated zinc is gradually covered by the deposited tin and then the rate of the deposition of tin becomes low. For instance, the rate of the deposition of tin becomes remarkably low at above 0.4 g/m$^2$ of deposited tin, even if the plated zinc is present in a sufficient amount required for the deposition of 1.0 g/m$^2$ of tin. In this case, electroplating should be carried out after the immersion tinplating in order to supplement the deficiency of tin. In the present invention, electrotinplating after the immersion tinplating is carried out under the same conditions as in conventional tinplating. It is desirable that the temperature of tinplating bath be 20°–60° C. and the current density be 5–50 A/dm$^2$. Generally, lower current density is applied for the formation of a uniform tin layer at lower bath temperature and lower concentration of stannous ion. On the contrary, at higher bath temperature and high concentration of stannous ion, a higher current density is applied. Furthermore, in the case where the concentration of stannous ion below 2 g/l, the electrical resistance of the bath increases and the current efficiency for tinplating becomes very low, and therefore, such low concentration of stannous ion is not suitable for industrial production of the thin tin and zinc plated steel sheet according to the present invention.

The composition of the zinc plating bath used in the present invention is naturally regulated because the zinc ions therein substantially replace the stannous ions during the tin-plating. For instance, if a stannous sulfate bath is used for tinplating, a zinc sulfate bath containing the same anion and the same additives is used for zinc plating on the steel sheet in the present invention.

The concentration of zinc ion in the zinc plating bath should be controlled in the range of 10–100 g/l. If the concentration of zinc ion is below 10 g/l, it is not suitable for industrial production of the thin tin and zinc plated steel sheet according to the present invention, because the electrical resistance of the zinc plating bath is high and a rectifier having a large capacity is necessary. The use of a zinc plating bath having above 100 g/l of zinc ion is not economical.

In the case of zinc plating by using the zinc plating bath obtained from the tinplating bath having a small amount of stannous ion, therefore, zinc ion should be supplied by the addition of a zinc salt having the same anion as in the tinplating bath, zinc hydroxide or the dissolution of zinc. For instance, if the tinplating bath having 2 g/l of stannous ion is used for tinplating, at least about 9.9 g/l of zinc ion should be supplied to the zinc plating bath obtained from this tinplating bath, even if 2 g/l of stannous ion is completely replaced by zinc ion.

The concentration of stannous ion in the zinc plating bath should be kept below 1 g/l, desirably almost zero, because the excess amount of tin is preferentially deposited during electroplating zinc of the amount required in the present invention.

When a small amount of stannous ion is present in the zinc plating bath, the pH of the zinc plating bath should be kept below 1.7 in zinc sulfate bath or zinc phenolsulfonate bath and below 4.0 in zinc halogenide bath, because stannous ion is precipitated in zinc plating bath at above the pH described above and gives a bad appearance in the thin tin and zinc plated steel sheet according to the present invention.

In the absence of stannous ion in the zinc plating bath, the pH of the zinc plating bath may be raised to about 7 by the addition of alkali hydroxide, alkali oxide or zinc hydroxide.

In this case, however, water rinsing should be preferably carried out after zinc plating in order to prevent the rise of pH in the tinplating bath, although it may be omitted in the use of the zinc plating bath being below 1.7 or 4.0 of pH.

In zinc plating, it is preferable to control the temperature of the zinc plating bath in the range of 20°–60° C. from the industrial and economical viewpoints. At a temperature of the zinc plating bath above 60° C., some additives such as ethoxylated α-naphthol used in the tinplating bath may be decomposed.

Furthermore, the cathodic current density for zinc plating is 0.1–100 A/dm$^2$, preferably 1–70 A/dm$^2$ in the present invention. A lower current density below 0.1 A/dm$^2$ is not suitable for the continuous production of the thin tin and zinc plated steel sheet at high speed. A higher current density above 100 A/dm$^2$ is not also suitable because a rectifier having a large capacity is necessary.

In the process according to the present invention, it is very important to control the amount of the electroplated zinc, because the amount of the plated tin depends on the amount of the dissolved zinc in the immersion tinplating. Namely, 1 mole/dm$^2$ of tin is theoretically plated by the dissolution of 1 mole/dm$^2$ of the plated zinc. Therefore, for the deposition of 0.05–1.0 g/m$^2$ of tin, the dissolution of 0.028–0.55 g/m$^2$ of the plated zinc is necessary. In the determination of the amount of the zinc remaining after tinplating, the amount of the electroplated zinc is calculated by the following equation:

$$\text{The amount of the plated zinc (g/m}^2) = \text{the amount of the plated tin} \times \frac{65.37}{118.69} + 0.005 - 0.2$$

However, it is difficult from a practical standpoint to deposit above 0.4 g/m$^2$ of tin by the immersion tinplating because the surface of the plated zinc is gradually covered by the deposited tin and then the rate in the deposition of tin becomes remarkably low.

Therefore, it is desirable in the present invention that the amount of the electroplated zinc be below 0.42 g/m$^2$ for producing the thin tin and zinc plated steel sheet at high speed.

In some cases, heating the thin tin and zinc plated steel sheet at a temperature above melting point of tin and quenching are carried out, in order to improve lacquer adhesion, although the weldability at high speed becomes slightly poorer. In the case of a light tin coating weight, such as 0.10 g/m$^2$, the plated tin is sufficiently converted to an iron-tin alloy by heating at a somewhat higher temperature (about 250° C.) than the melting point of tin. However, for a heavy tin coating weight, such as 0.8 g/m$^2$, heating at a considerably higher temperature (300°–400° C.) than the melting point of tin is necessary. Generally, it is necessary that the temperature during formation of the iron-tin alloy be maintained in the range of 232°–400° C. for 0.5–10 seconds.

In this case, heating is carried out by a known method such as resistance heating and/or induction heating which is generally used in the manufacturing process of conventional electrotinplated materials.

Furthermore, the thin tin and zinc plated steel sheet according to the present invention is subjected to a cathodic treatment or an immersion treatment in a known solution containing hexavalent chromium ion such as a sodium dichromate solution or chromic acid solution which is generally used for the post-treatment of conventional electrotinplated materials. A phosphate treatment or sodium carbonate treatment can be used for the post-treatment of the thin tin and zinc plated steel sheet instead of chromate treatment.

The present invention is illustrated by the following Examples:

EXAMPLE 1

A cold reduced steel sheet having a thickness of 0.22 mm was electrolytically degreased in a solution of 70 g/l sodium hydroxide and then cathodically pickled in a solution of 30 g/l of sulfuric acid. The steel sheet, after rinsing with water, was electroplated with zinc under the following plating conditions:

Conditions of electroplating of zinc:
Composition of bath
$ZnSO_4.7H_2O$: 50 g/l
$H_2SO_4$: 3 g/l
Ethoxylated α-naphthol: 2 g/l
pH: 1.6
Bath temperature: 40° C.
Cathodic current density: 10 A/dm$^2$
Amount of plated zinc: 0.32 g/m$^2$ After rinsing with water, the zinc plated steel sheet was plated with tin by immersion into the tinplating bath consisting of 5 g/l of $SnSO_4$, 3 g/l of $H_2SO_4$ and 2 g/l of ethoxylated α-naphthol and having a pH of 1.1, for 3 seconds at a bath temperature of 40° C.

After rinsing with water, the tin and zinc plated steel sheet was cathodically treated in 30 g/l of sodium dichromate under 5 A/dm$^2$ at a bath temperature of 50° C. and was rinsed with water, dried and coated with dioctyl sebacate of 4 mg/m$^2$ by the ordinary method used in conventional electroplating processes.

EXAMPLE 2

A steel sheet pretreated as in Example 1 was electroplated with zinc under the following plating conditions:

Conditions of electroplating of zinc:
Composition of bath
$ZnSO_4.7H_2O$: 50 g/l
Phenolsulfonic acid (60% aqueous solution): 50 g/l
Ethoxylated α-naphthol sulfonic acid: 4 g/l
pH: 0.9
Bath temperature: 50° C.
Cathodic current density: 15 A/dm$^2$
Amount of plated zinc: 0.41 g/m$^2$ Without rinsing with water, the zinc plated steel sheet was plated with tin by the immersion into the tinplating bath consisting of 60 g/l of $SnSO_4$, 50 g/l of phenolsulfonic acid (60% aqueous solution) and 4 g/l of ethoxylated α-naphthol sulfonic acid and having a pH of 0.6, for 1 second at a bath temperature of 50° C. and then electroplated with tin by using the same tinplating bath under a current density of 8 A/dm$^2$.

After rinsing with water, the thin tin and zinc plated steel sheet was treated in the same manner as mentioned in Example 1.

EXAMPLE 3

A steel sheet pretreated as in Example 1 was electroplated with zinc under the following conditions:

Conditions of electroplating of zinc:

Composition of bath $ZnCl_2$: 300 g/l

NaCl: 45 g/l

NaF: 25 g/l $KHF_2$: 50 g/l pH: 1.8

Bath temperature: 55° C.

Cathodic current density: 20 A/dm$^2$

Amount of plated zinc: 0.24 g/m$^2$

After rinsing with water, the zinc plated steel sheet was electroplated with tin by immersion into the tinplating bath consisting of 75 g/l of $SnCl_2.2H_2O$, 45 g/l of NaCl, 25 g/l of NaF and 50 g/l of $KHF_2$ and having a pH of 1.8, for 0.7 seconds at a bath temperature of 55° C.

After rinsing with water, the thin tin and zinc plated steel sheet was immersed in 50 g/l of sodium dichromate solution for 3 seconds at a bath temperature of 40° C. and was rinsed with water, dried. After that, dioctyl sebacate is coated as in Example 1.

EXAMPLE 4

A steel sheet pretreated as in Example 1 was electroplated with zinc under the following conditions:

Conditions of electroplating of zinc:

Composition of bath $ZnCl_2$: 200 g/l $SnCl_2.2H_2O$: 0.4 g/l

NaCl: 30 g/l

NaF: 15 g/l $KHF_2$: 35 g/l pH (controlled by addition of NaOH): 3.5

Bath temperature: 40° C.

Cathodic current density: 5 A/dm$^2$

Amount of plated zinc: 0.15 g/m$^2$

After rinsing with water, the zinc plated steel sheet was plated with tin by immersion into the tinplating bath used in Example 3 for 0.5 seconds at a bath temperature of 55° C.

After rinsing with water, the thin tin and zinc plated steel sheet was treated in the same manner as mentioned in Example 1.

EXAMPLE 5

A steel sheet pretreated as in Example 1 was plated with zinc and tin under the same conditions as in Example 3.

After rinsing with water and drying, the thin tin and zinc plated steel sheet was kept at a temperature of 232°-250° C. for 2 seconds by resistance heating, and then was immediately quenched. This treated steel sheet was cathodically treated in the same manner as mentioned in Example 1.

COMPARATIVE EXAMPLE 1

A steel sheet pretreated as in Example 1 was electroplated with tin by using the tinplating bath used in Example 2 under a current density of 10 A/dm$^2$ at a bath temperature of 50° C.

After rinsing with water, the tin plated steel sheet was treated in the same manner as mentioned in Example 1.

The characteristics of the resultant tin and zinc plated steel sheet were evaluated by the following testing methods, after the measurement of the coating weight on the resultant sheet by the X-ray fluorescent method, the results of which are shown in the attached Table.

(1) Weldability

The weldability of the resultant sheet was evaluated by using a wire seam welding machine having a copper wire as an intermediate electrode under the following welding conditions:

Welding conditions:

Power supply frequency: 250 Hz

Welding speed: 30 m/min.

Overlap of sheet: 0.45 mm

Added pressure: 45 kg

The weldability was shown as an available range of secondary current in welding. The upper limit in the available secondary current range corresponds to the welding conditions in which some defect such as splashing is found and the lower limit corresponds to the welding conditions in which the breakage occurs in the parent metal or welded part by tearing tests. The wider the secondary current range in welding, the better the weldability.

(2) Filiform Corrosion Resistance

The resultant sheet was baked at 200° C. for 10 minutes after coating with 70 mg/dm$^2$ of vinyl type organosol (Trade name SJ-9434-003 of Kansai Paint Co., Ltd., Japan).

The coated sample was cut to a size of 9 cm×9 cm, and the coated side was cut crosswise with a razor. After 5 mm of the sample was extruded by using a conventional Erichsen testing machine, the formed sample was set in a chamber into which 5% sodium chloride solution heated to 38° C. was sprayed for one hour.

After rinsing with water, the formed sample was set under the relative humidity of 85% at 25° C. for weeks.

After that, the degree of filiform corrosion was divided into 5 ranks by the naked eye, namely, 5 was excellent, 4 was good, 3 was fair, 2 was poor and 1 was bad.

As apparent from the Table, the thin tin and zinc plated steel sheet according to the present invention has an excellent weldability and an excellent filiform corrosion resistance.

TABLE

| | Example 1 | Example 2 | Example 3 | Example 4 | Example 5 | Comp. Example 1 |
|---|---|---|---|---|---|---|
| Amount of zinc (g/m$^2$) | 0.08 | 0.19 | 0.05 | 0.03 | 0.06 | [illegible] |
| Amount of tin (g/m$^2$) | 0.42 | 0.90 | 0.34 | 0.21 | 0.35 | 0.54 |
| Amount of $Cr^{ox}$ (g/m$^2$) | 0.005 | 0.006 | 0.003 | 0.005 | 0.006 | 0.005 |
| Filiform corrosion resistance | 5 | 5 | 5 | 4 | 5 | [illegible] |

TABLE-continued

| | Example 1 | Example 2 | Example 3 | Example 4 | Example 5 | Comp. Example 1 |
|---|---|---|---|---|---|---|
| Weldability (Available range of secondary current) | 140 A | 320 A | 130 A | 100 A | 100 A | 70 A |

Remarks:
(1) Tin in Example 5 changes to iron-tin alloy by heating.
(2) $Cr^{ox}$ is chromium in the formed hydrated chromium oxide.

We claim:

1. A process for producing a thin tin and zinc plated steel sheet having 0.005–0.2 g/m$^2$ of zinc and 0.05–1.0 g/m$^2$ of tin which comprises:
   (a) electroplating zinc on a substantially clean steel sheet in an aqueous electroplating bath containing zinc ions with or without additives,
   (b) tinplating the zinc plated sheet of step (a) by immersion or by immersion followed by electroplating in an aqueous, acidic tin plating bath containing stannous ions, whereby zinc ions from the zinc plated steel sheet replace the stannous ions in the tinplating solution during the immersion tinplating and
   (c) recycling the resultant solution from step (b), which contains zinc ions, to make up the zinc electroplating bath of step (a).

2. The process according to claim 1, wherein the source of said stannous ions in the tinplating bath of step (b) is stannous sulfate, stannous phenolsulphonate or stannous halogenide.

3. The process according to claim 1 or claim 2, wherein the tin and zinc plated steel sheet of step (b) is heated at a temperature sufficiently above the melting point of tin for a time sufficient to form an iron-tin alloy.

4. The process according to claim 3, wherein heating said tin and zinc plated steel sheet is carried out at a temperature of 232°–400° C. for 0.5–10 seconds.

5. The process according to claim 3, wherein the stannous ions in said tinplating solution are substantially exhausted before said solution is recycled to step (a).

6. The process according to claim 1 or claim 2, wherein the concentration of zinc ions in said recycled solution is supplemented by the dissolution of zinc metal, the addition of zinc hydroxide or the addition of a zinc salt having the same anion as the tinplating bath.

7. The process according to claim 1 or claim 2, wherein the tinplating solution and zinc electroplating solution contain the same anions and additives.

8. The process according to claim 7, wherein the stannous ions in said tinplating solution are substantially exhausted before said solution is recycled to step (a).

9. The process according to claim 1 or claim 2, wherein electroplating of zinc is carried out in a zinc plating bath having the same anion and the same additives used for the tinplating bath at a temperature of 20°–60° C. and a cathodic current density of 0.1–100 A/dm$^2$, the concentration of zinc ion in the bath being 10–100 g/l, the concentration of stannous ion in the bath being below 1 g/l.

10. The process according to claim 9, wherein electroplating of zinc is carried out in a zinc sulfate bath or zinc phenolsulfonate bath with the pH of the bath being below 1.7.

11. The process according to claim 9, wherein electroplating of zinc is carried out in a zinc halogenide bath with the pH of the bath being below 4.0.

12. The process according to claim 1 or claim 2, wherein electroplating of zinc is carried out in a zinc plating bath having the same anion and the same additives used for the tinplating bath at a temperature of 20°–60° C. and a cathodic current density of 5–70 A/dm$^2$, the concentration of zinc ion in the bath being 10–100 g/l, the concentration of stannous ion in the bath being below 1 g/l.

13. The process according to claim 12, wherein electroplating of zinc is carried out in a zinc sulfate bath or zinc phenolsulfonate bath with the pH of the bath being below 1.7.

14. The process according to claim 12, wherein electroplating of zinc is carried out in a zinc halogenide bath with the pH of the bath being below 4.0.

15. The process according to claim 1 or claim 2, wherein tinplating is carried out in a stannous sulfate bath or a stannous phenolsulfonate bath at a temperature of 20°–60° C. and the immersion time in said tinplating bath being 0.1–5 seconds, the concentration of stannous ion being 2–70 g/l, the pH of the bath being below 1.7.

16. The process according to claim 1 or claim 2, wherein tinplating is carried out in a stannous halogenide bath at a temperature of 20°–60° C. and the immersion time in said tinplating bath being 0.1–5 seconds, the concentration of stannous ion being 2–70 g/l, the pH of the bath being below 4.0.

17. The process according to claim 1 or claim 2, wherein tinplating is carried out by an electroplating under a cathodic current density of 5–50 A/dm$^2$ after an immersion for 0.1–5 seconds into a stannous sulfate bath or a stannous phenolsulfonate bath at a temperature of 20°–60° C., the concentration of stannous ion being 2–70 g/l, the pH of the bath being below 1.7.

18. The process according to claim 1 or claim 2, wherein tin-plating is carried out by an electroplating under a cathodic current density of 5–50 A/dm$^2$ after an immersion for 0.1–5 seconds into a stannous halogenide bath at a temperature of 20°–60° C., the concentration of stannous ion being 2–70 g/l, the pH of the bath being below 4.0.

19. The process according to claim 1 or claim 2, wherein 0.05–1.0 g/m$^2$ of tin is plated by immersion or by electroplating after immersion of the zinc plated steel sheet of step (a) having 0.032–0.42 g/m$^2$ of zinc, into said tinplating bath.

20. The process according to claim 1 or claim 2, wherein the zinc plated steel sheet of step (a) is washed with water before being treated in step (b).

21. The process according to claim 1 or claim 2, wherein the stannous ions in said tinplating solution are substantially exhausted before said solution is recycled to step (a).

* * * * *